US008955941B2

(12) United States Patent
Imoto

(10) Patent No.: US 8,955,941 B2
(45) Date of Patent: Feb. 17, 2015

(54) IMAGE FORMING APPARATUS AND METHOD CAPABLE OF WEAKENING ELECTRIC FIELD FORMED UNDER PRINTING HEAD

(71) Applicant: Shinji Imoto, Tokyo (JP)

(72) Inventor: Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/190,261

(22) Filed: Feb. 26, 2014

(65) Prior Publication Data

US 2014/0267486 A1 Sep. 18, 2014

(30) Foreign Application Priority Data

Mar. 14, 2013 (JP) ..... 2013-052444

(51) Int. Cl.
*B41J 29/38* (2006.01)
*B41J 2/045* (2006.01)

(52) U.S. Cl.
CPC ..... *B41J 2/04501* (2013.01)
USPC ..... 347/16

(58) Field of Classification Search
CPC ..... B41J 11/0095; B41J 13/103; B41J 29/38; B65H 2301/5322; B65H 2404/20; B65H 5/004
USPC ..... 347/5, 8, 16, 101, 104
See application file for complete search history.

(56) References Cited

U.S. PATENT DOCUMENTS

| | | | | |
|---|---|---|---|---|
| 7,621,632 | B2 * | 11/2009 | Imoto et al. | 347/104 |
| 8,043,016 | B2 * | 10/2011 | Kogure et al. | 400/279 |
| 2006/0055754 | A1 | 3/2006 | Sakuma et al. | |
| 2006/0164491 | A1 | 7/2006 | Sakuma et al. | |
| 2006/0256352 | A1 | 11/2006 | Kogure et al. | |
| 2007/0103532 | A1 | 5/2007 | Imoto et al. | |
| 2007/0109385 | A1 | 5/2007 | Imoto et al. | |
| 2008/0043083 | A1 | 2/2008 | Imoto et al. | |
| 2008/0106566 | A1 | 5/2008 | Kogure et al. | |
| 2008/0145123 | A1 | 6/2008 | Kogure et al. | |
| 2009/0052917 | A1 | 2/2009 | Kogure et al. | |
| 2009/0073211 | A1 | 3/2009 | Imoto | |
| 2009/0074461 | A1 | 3/2009 | Imoto | |
| 2009/0102908 | A1 | 4/2009 | Imoto | |

FOREIGN PATENT DOCUMENTS

| | | |
|---|---|---|
| JP | 5-008392 | 1/1993 |
| JP | 2000-025249 | 1/2000 |

* cited by examiner

*Primary Examiner* — An Do

(74) *Attorney, Agent, or Firm* — Cooper & Dunham LLP

(57) ABSTRACT

An image forming apparatus includes a printing device; a printing medium conveying unit to convey a printing medium, a first electric charger to charge the printing medium conveying unit, a second electric charger to charge the printing medium conveyed by the printing medium conveying unit, a first surface potential detector to detect a surface potential of the printing medium bearing the electric charge, a second surface potential detector to detect a surface potential of the printing medium bearing the electric charge, and a controller to adjust a power supply voltage supplied to each of the first and second electric chargers in accordance with each of surface potentials detected by the first and second surface potential detectors. The first and second surface potential detectors are located at different positions in a conveying direction in which the printing medium is conveyed by the printing medium conveying unit.

14 Claims, 11 Drawing Sheets

IMAGE FORMING APPARATUS AND METHOD CAPABLE OF WEAKENING ELECTRIC FIELD FORMED UNDER PRINTING HEAD

CROSS-REFERENCE TO RELATED APPLICATION

This patent application is based on and claims priority pursuant to 35 U.S.C. §119 to Japanese Patent Application No. 2013-052444, filed on Mar. 14, 2013 in the Japan Patent Office, the entire disclosure of which is hereby incorporated by reference herein.

BACKGROUND

1. Technical Field

This invention relates to an image forming apparatus and method, and in particular to an image forming apparatus and method capable of weakening an electric field generated under a printing head.

2. Related Art

As an image forming apparatus, such as a printer, a facsimile machine, a copier, a plotter, a multifunctional machine combining these capabilities, etc., an ink-jet printer that employs a droplet ejecting-type printing system with a droplet discharging head that ejects droplet is known.

In such an image forming apparatus, a droplet having landed on a printing medium takes a long time to dry and form an image thereon. For this reason, the printing medium is conveyed with its image forming surface distanced from (i.e., not contacting) a sheet conveyor until the droplet on the printing medium dries.

Certain known conveying systems convey the printing medium using electrostatic force generated in a sheet conveyor to attract the printing medium. However, the electric potential at the sheet conveyor cannot be completely eliminated under a printing head acting as an image forming device because the electric charge previously given to the sheet conveyor remains. As a result, an ink mist readily refluxes to the printing head due to the electric field.

Moreover, a surface electric potential of the sheet at a position in a conveyance path opposed to a surface potential sensor is different from that under the printing head especially in low-temperature or low-humidity environments, in which the electrical resistance of the sheet generally increases, making it difficult to negate the electric field.

SUMMARY

Accordingly, one aspect of the present invention provides a novel image forming apparatus that includes an image forming device to eject a droplet and form an image on a printing medium; a sheet conveying unit to convey the printing medium with the image; at least one rust electric charger to charge the sheet conveying unit; a second charger to charge the printing medium conveyed by the sheet conveying unit; a first surface potential detector to detect a surface potential of the printing medium bearing the electric charge; a second surface potential detector to detect a surface potential of the printing medium bearing the electric charge; and a controller to adjust a power supply voltage supplied to each of the first and second electric chargers in accordance with each of surface potentials detected by the first and second surface potential detectors. The first and second surface potential detectors are located at different positions in a conveying direction in which the printing medium is conveyed by the sheet conveying unit.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
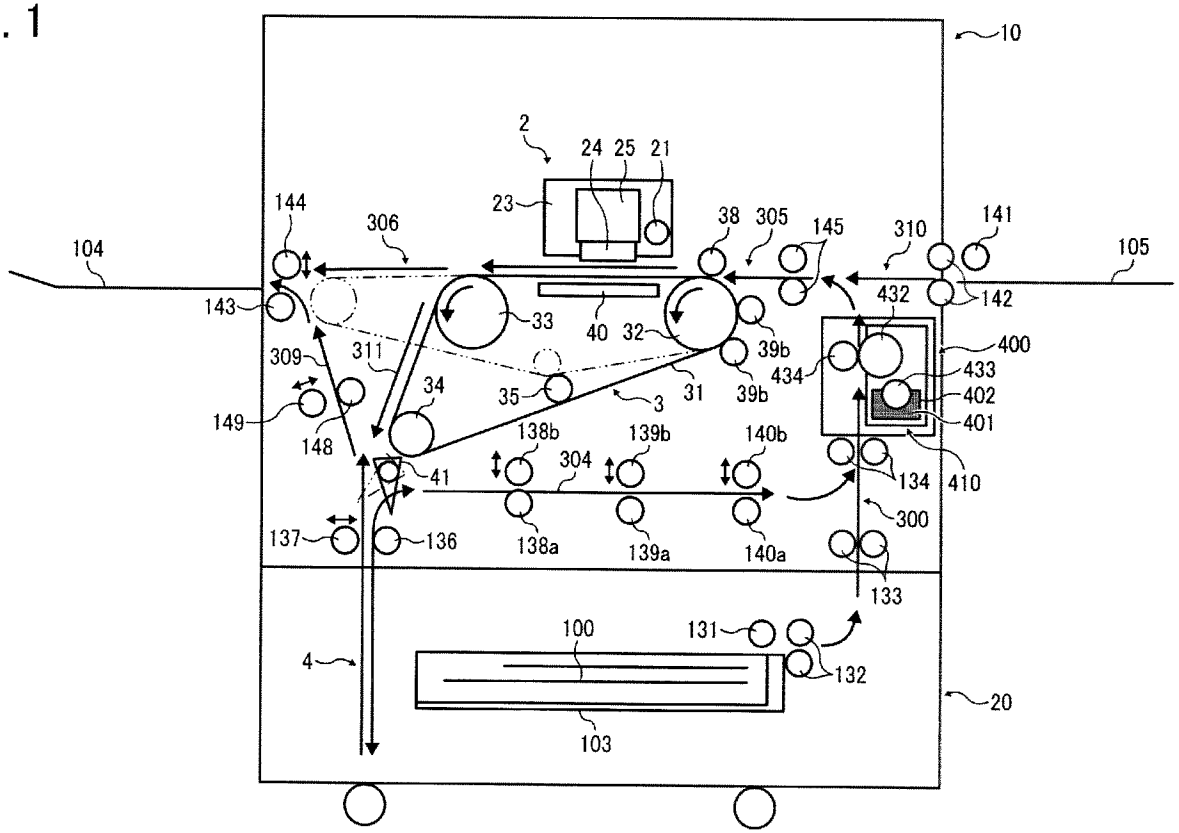
FIG. 1 is a diagram illustrating the overall configuration of an exemplary image forming apparatus according to one embodiment of the present invention.
Figure 2:
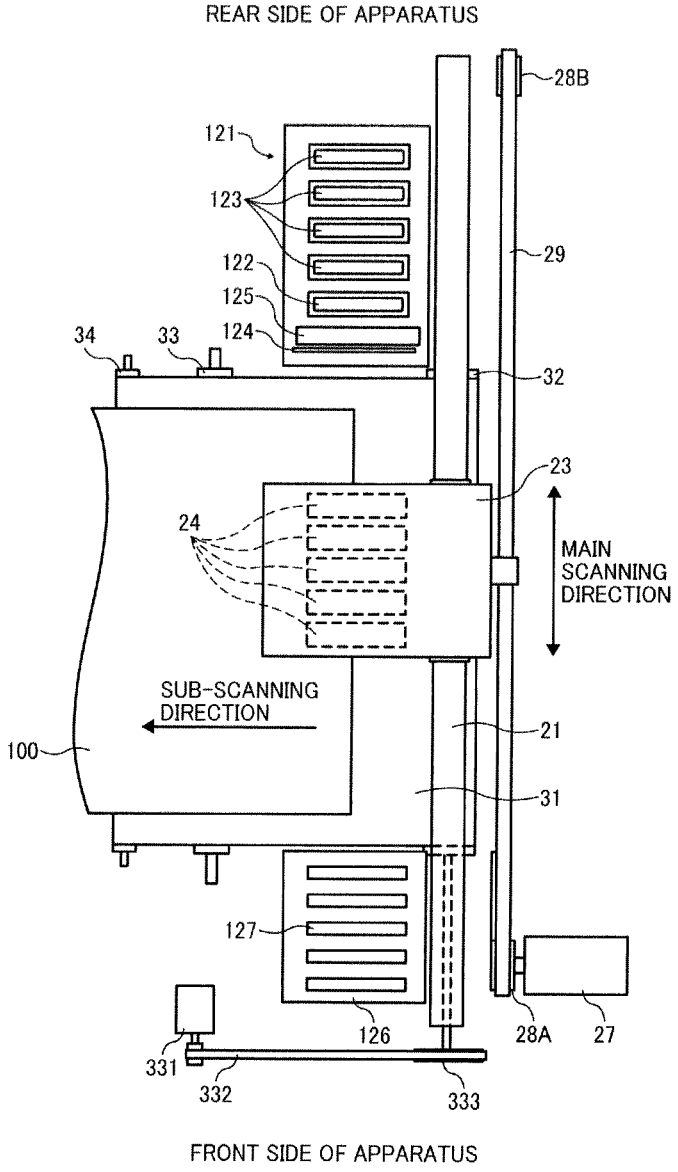
FIG. 2 is a schematic plan view illustrating a mechanism included in the image forming apparatus of FIG. 1 according to one embodiment of the present invention.
Figure 3:
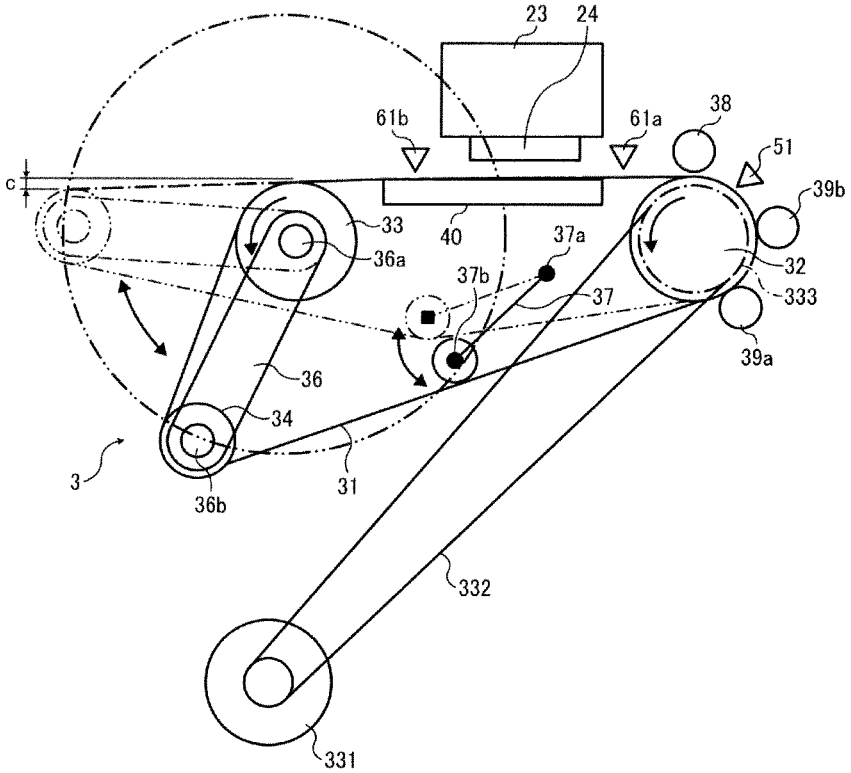
FIG. 3 is a side view illustrating a sheet conveying unit disposed in the image forming apparatus of FIG. 1 according to one embodiment of the present invention.
Figure 4:
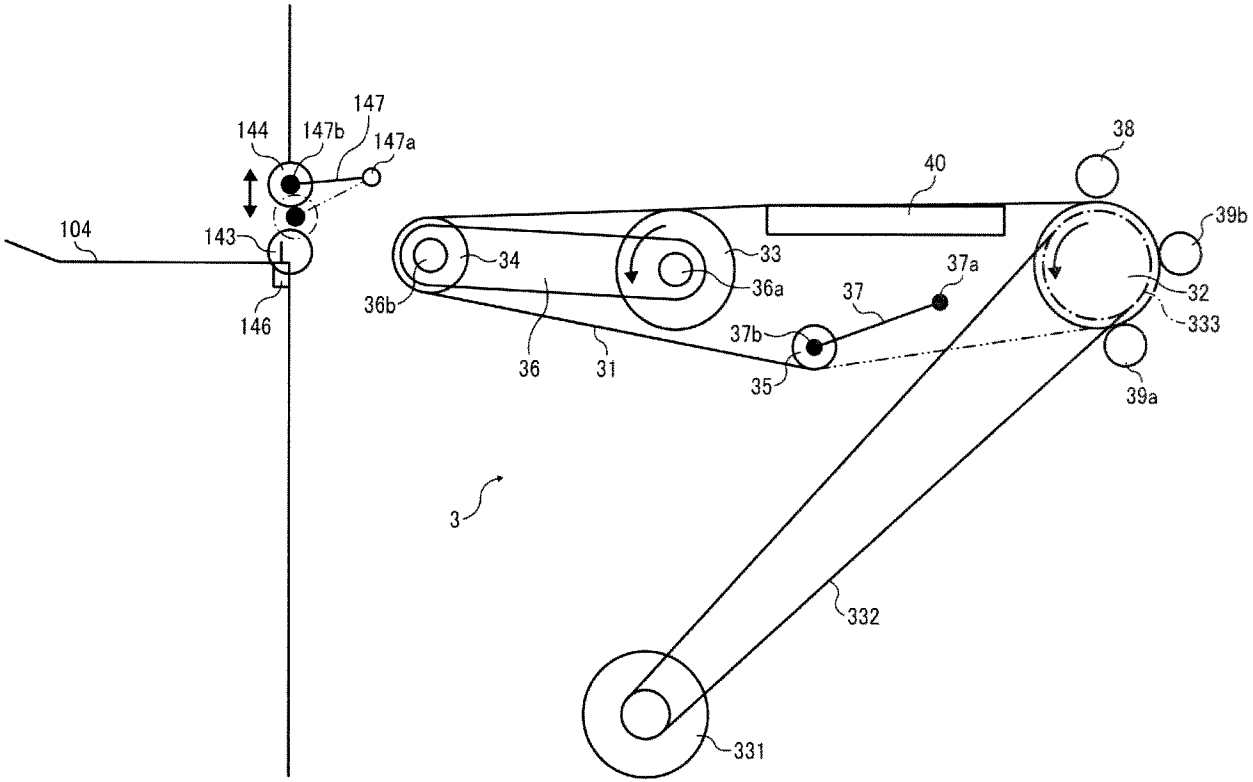
FIG. 4 is a diagram illustrating both an aspect of the image forming apparatus of FIG. 1 and another mechanism provided in the image forming apparatus to engage and disengage a driven roller with a driving roller when a sheet is linearly ejected therefrom according to one embodiment of the present invention.

Referring now to the drawings, wherein like reference numerals designate identical or corresponding parts throughout the several views thereof and in particular to FIGS. 1 to 4, an exemplary image forming apparatus according to one embodiment of the present invention is described. Specifically, the overall configuration of an exemplary image forming apparatus is illustrated in FIG. 1. A prescribed mechanism is included in the image forming apparatus as shown in FIG. 2. A sheet conveying unit is disposed in the image forming apparatus as shown in FIG. 3. The prescribed mechanism causes a driven roller to engage and disengage with a driving roller when a sheet is linearly ejected from the image forming apparatus as shown in FIG. 4.

The image forming apparatus includes an image forming unit 2 acting as an image forming device to form an image by ejecting a droplet onto a sheet 100 acting as a printing medium. The image forming apparatus also includes a sheet conveying unit 3 acting as a sheet conveyor to convey the sheet 100 inside an apparatus body 10. The image forming apparatus also includes a processing liquid coating unit 400 on an upstream side of the image forming unit 2 in a sheet conveying direction to coat the sheet 100 with processing liquid 401. The image forming apparatus also includes a sheet-inverting unit 4 to invert the sheet 100 bearing the image thereon. The image forming apparatus also includes a sheet-exiting tray 104 to receive the sheet 100 drained therefrom. The image forming apparatus also includes a sheet feeding unit 20 having a sheet feeding cassette 103 disposed in a lower section of the apparatus body 10 to accommodate multiple sheets 100.

Here, as shown in the FIGS. 1 and 2, the image forming unit 2 movably holds a carriage 23 in the main scanning direction, which is prepared by aligning multiple printing heads of respective colors in a main scanning direction using a guiding rod 21 and a guiding stay, not shown in drawing. The carriage 23 moves and executes scanning in the main scanning direction when driven by a main scanning motor 27 via a timing belt 29 wound around driving and driving pulleys 28A and 28B.

Here, on the carriage 23, a printing head unit 24 composed of five units of droplet discharging heads which eject droplets of respective colors of black (Bk), cyan (C), magenta (M), and yellow (Y), is mounted. Further, two Bk printing heads are used, however. With such a configuration, an image is formed by ejecting an applicable droplet from the printing head unit 24 onto a sheet while moving the carriage 23 in the main scanning direction and conveying the sheet 100 from the sheet conveying unit 3 acting as a sheet conveyor in a sheet conveying direction (i.e., a sub-scanning direction) in a manner called a shuttle type system.

Here, a line type printing head prepared by aligning multi printing heads of respective colors in the sub-scanning direction can be alternatively utilized as well. However, the present invention is not limited to the above-described orientations of alignment of printing heads and nozzle lines of the printing heads, and an alignment order of respective colors.

Further, also on the carriage 23, multiple printing head tanks 25 are mounted to supply droplets of multiple colors to the respective printing heads 24. Although it is not shown, to the multiple printing head tanks 25, prescribed multiple color droplets are respectively supplied from the droplet cartridges removably mounted on the apparatus body 10 from a front side thereof. Here, the image forming apparatus is enabled to supply black ink from a single droplet cartridge to the pair of printing head tanks 25.

The printing head unit 24 can employ a pressure generating device, such as a piezoelectric-type actuator, a thermal type actuator, an electrostatic type actuator, etc. However, the present invention is not limited to the above-described exemplary droplet discharging unit.

Further, as shown in FIG. 2, a maintenance and recovery mechanism 121 is disposed in a non-printing region located at a widthwise one side end (of the image forming apparatus) in the scanning direction of the carriage 23 to recover and maintain a condition of the nozzle of the printing head unit 24.

The maintenance and recovery mechanism 121 includes a suction cap 122 connected to a suction device (not shown) to cap five surfaces of printing heads 24 and four moisture retaining caps 123. The maintenance and recovery mechanism 121 includes a wiper 124 to wipe the multiple nozzle surfaces of the printing heads 24. The maintenance and recovery mechanism 121 includes a trial discharged ink receiver 125 to receive a droplet not contributing to printing (i.e., image formation) discharged thereon (as trial ink discharging).

Further, as shown in FIG. 2, a trial discharged ink receiver 126 is also disposed in a non-printing region at the other side (of the image forming apparatus) in the scanning direction of the carriage 23 to receive droplets discharged from the five printing heads 24 thereon not contributing to printing (i.e. image formation) (as trial ink discharging). In the trial discharged ink receiver 126, the five openings 127 are formed corresponding to the printing heads 24.

Further, as also shown in FIG. 3, a sheet conveying belt 31 acting as an endless shut conveyor is provided in the sheet conveying unit 3 to adsorb and send the sheet 100 fed from the bottom while directing the sheet to face an image forming unit 2.

The sheet conveying belt 31 is wound around a conveying roller 32 acting as a driving roller, another conveying roller 33 that keeps an image formation region flat in cooperation with the conveying roller 32, a separating roller 34 arranged downstream of the conveying roller 33 in the sheet conveying direction, and a tension roller 35. A guide member 40 is also disposed facing the image forming unit 2 to guide the sheet conveying belt 31 in an opposed region.

The sheet conveying belt 31 is preferably a two-tiered structure, for example, including a front surface acting as a sheet adsorption surface made of pure resin such as ETFE (Ethylene tetrafluoroethylene Ethylene tetrafluoroethylene) pure materials, etc., not subjected to resistance control, and a back side layer (e.g. a medium resistance layer, a grounded layer) made of the same material with that of the front surface and is subjected to the resistance control with carbon. However, the present invention is not limited to the above-described configuration, and alternatively, the sheet conveying belt 31*a* can be constituted as a single layer or as a multilayer structure having three or more layers.

Further, the separating roller 34 is provided to separate the sheet 100 with the image adhering to the sheet conveying belt 31 using a curvature separation principle. As shown in FIG. 3, the separating roller 34 is rotatably held by a shaft 36*b* provided at a tip of a movably rotatable link 36 movable around a rotating center of the conveying roller 33 acting as a supporting point 36*a* in a direction as indicated by an arrow. The separating roller 34 is also enabled to swing between two corresponding positions in multiple conveying paths as shown by solid and broken lines, respectively. Specifically, the separating roller 34 is positioned to be able to convey the sheet 100 in each of the sheet conveying paths.

Here, by moving it to a position as shown by the broken line in the drawing, the separating roller 34 switches its position to enter the straight sheet ejecting path 306, in which the sheet 100 bearing the image thereon is linearly conveyed and sent toward the sheet-exiting tray 104.

By contrast, by moving it to a position as shown by the solid line in the drawing, the separating roller 34 switches its position to enter a sheet inverting path 311, in which the sheet 100 bearing the image is sent to a sheet-inverting unit 4.

Here, a sheet conveyance distance between a position in which the sheet 100 is separated from the sheet conveying belt 31, and that, in which the image forming unit 2 is disposed, in the straight sheet ejecting path 306 is desirably substantially the same to that in the sheet inverting path 311. Specifically, with such an arrangement, a drying degree of the sheet 100 can be the same regardless of a type of the sheet conveying path, in which the sheet 100 is conveyed (i.e., the straight sheet ejecting path 306 or the sheet inverting path 311).

In such a situation, since the separating roller 34 is rotatable around the rotational center of the conveying roller 33 acting as a fulcrum as described above, a sheet conveying distance between a position from which the separating roller 34 separates the sheet 100 from the sheet conveying belt 31 to a position in which the image forming unit 2 is disposed can be readily substantially equalized both in the straight sheet ejecting path 306 and the sheet inverting path 311.

Here, the separating roller 34 is positioned at a prescribed place (at a given minimum distance from the conveying roller 33) enabling the sheet conveying belt 31 to always contact the conveying roller 33 with a prescribed tension. Hence, even when the sheet conveying path is switched to the other, a posture of the sheet conveying belt 31 does not change at an image forming region, so that an image can be steadily formed.

Further, when it is located at a position as shown by the broken line in the drawing, the separating roller 34 as a whole is positioned below a conveying surface formed by the pair of conveying rollers 32 and 33 that holds the sheet conveying belt 31 facing the image forming unit 2. Specifically, the separating roller 34 is placed lower than the conveying surface by just a distance c as shown in FIG. 3. With this, the sheet conveying belt 31 can absolutely contact the conveying roller 33 while ensuring its flatness.

Further, as shown in FIG. 3, a tension roller 35 is held by an arm 37 that is swingable between positions as shown by solid and broken lines in a direction as indicated by an arrow in the drawing. Specifically, the arm 37 is swingable around a rotation fulcrum 37*a* acting as a fulcrum and rotatably holds the tension roller 35 around a holding fulcrum 37*b*. The arm 37 is pressed by a pressing device, not shown, in a direction in which the tension roller 35 presses the sheet conveying belt 31 in a prescribed direction.

Hence, the tension roller 35 moves following the sheet conveying belt 31 even when the sheet conveying belt 31 displaces due to swinging of the separating roller 34, and accordingly, provides a tension to the sheet conveying belt 31.

By contrast, on the upstream side of the image forming unit 2, a pressing member (e.g. a pressing roller) 38 that doubles as a second electric charge applying device is provided being opposed to the presses conveying roller 32 to press the sheet 100 against the sheet conveying belt 31 at an opposed position.

To adsorb the sheet 100 to the sheet conveying belt 31, a high power voltage (i.e. a power supply voltage), such as a DC voltage, a voltage prepared by superimposing a DC (Direct current) and an AC (Alternating current), etc., is supplied from a high voltage power supply (i.e., a DC bias supply unit or a DC and AC superposed bias supply unit and the like) to the pressing roller 38.

Further, on the downstream side of the pressing roller 38, a pair of surface potential sensors 61*a* and 61*b* is disposed to act as surface potential detectors each to detect a surface potential on the sheet 100 at different positions in the sheet conveying direction. Specifically, the surface potential sensor 61*a* serves as a first surface potential detector located on the upstream side of the image forming device (i.e., an image forming unit) 2. By contrast, the surface potential sensor 61*b* serves as a second surface potential detector located on the downstream side of the image forming device (i.e., an image forming unit) 2.

Further, to charge a surface of the sheet conveying belt 31, a pair of electric charging rollers 39*a* and 39*b* collectively acting as a first electric charging applying device is provided on the upstream side of the pressing roller 38 at different positions on the sheet conveying belt 31 in a belt circulating direction (i.e., a sheet conveying direction).

Hence, to charge the sheet conveying belt 31, a high DC voltage or a high voltage prepared by superimposing the DC and the AC (i.e., a power supply voltage) is supplied from the high voltage power supply (i.e., the DC bias supply unit or the DC and AC superimposed bias supply unit and the like) to this pair of electric charging rollers 39*a* and 39*b*.

Further, on the downstream side of the electric charging roller 39*b*, a surface potential sensor 51 is positioned to detect a surface potential of the sheet conveying belt 31.

Further, as shown in FIG. 3, as the conveying roller 32 is rotated by a sub-scanning motor 331 via a timing belt 332 and a timing roller 333, the sheet conveying belt 31 circulates in the sheet conveying direction (i.e., a sub-scanning direction) as shown in FIG. 2.

Further, the sheet-inverting unit 4 includes a conveying roller 136 composed of conductive elastic member placed on the downstream side of the sheet conveying belt 31 to act as a rotary sheet conveyor. Further, a driven roller 137 driven by the conveying roller 136 is provided to engage and disengage with the conveying roller 136 in the direction as indicated by an arrow to act as a driven rotated member. Further, the sheet-inverting unit 4 includes a path switching nail 41 that switches a sheet conveying path guiding the sheet 100 between a sheet inverting and ejecting path 309 and a double-sided sheet conveying path 304.

Specifically, the sheet-inverting unit 4 inverts it and sends the sheet 100 to one of the sheet inverting and ejecting path 309 and the double-sided sheet conveying path 304.

Here, at least a surface of the conveying roller 136 is composed of a conductive elastic member, such as conductive rubber, conductive sponge or similar material, etc. As the conductive elastic member of conductive rubber, solid rubber, such as EP rubber, chloroprene rubber, polyurethane rubber, etc., and material prepared by dispersing conductive carbon or conductive ions into foam rubber can be exemplified.

In such a situation, a volume resistivity of the conductive elastic member is preferably from about $10^2$ to about $10^{12}$ (Ω-cm), and is more preferably from about $10^3$ to about $10^6$ (Ω-cm).

Further, the driven roller 137 is placed to engage and disengage with the conveying roller 136 as described above and presses the sheet 100 against the conveying roller 136 as it engages with the sheet 100.

Hence, when a prescribed sheet type such as cardboard etc., or environment or the like which necessitates a prescribed feeding force larger than adsorption power of the sheet conveying roller 136 according to a previous analysis is detected based on an output from a sheet thickness sensor, that of a temperature and humidity sensor, not shown, or an input from a user, for example, the driven roller 137 is pressed against the conveying roller 136. With this, since conveying power increases, a problem, such as sheet jam, etc., can be likely prevented.

In the sheet inverting and ejecting path 309, into which the sheet 100 is sent from the sheet-inverting unit 4, a conveying roller 148 having at least a surface composed of a conductive elastic member is deployed to act as a rotary sheet conveyor similar to the conveying roller 136. Further, a driven roller 149 driven by the conveying roller 148 is also disposed as a driven rotated member to be able to engage and disengage with the conveying roller 148 in a direction as show by arrow in the drawing. Here, the conveying roller 148 is accordingly located on the downstream side of the sheet conveying belt 31.

To eject the sheet 100 fed out from both the sheet inverting and ejecting route 309 and the straight sheet ejecting path 306 onto the sheet-exiting tray 104, a conveying roller (i.e., a sheet exit roller) 143 at least having a surface composed of a conductive elastic member is positioned as a rotary conveyor similar to the conveying roller 136. Further, a driven roller 144 driven by the conveying roller 143 acting as a driven rotation member is also disposed to engage and disengage with the conveying roller 143. Here, the conveying roller 143 is accordingly located on the downstream side of the sheet conveying belt 31.

Further, on the downstream side of the conveying roller 143 and the upstream side of the sheet exit tray 104, an electric charge removing device (e.g., an electric charge removing brush) 146 is disposed to remove electric charge remaining on the sheet 100 drained. Specifically, the electric charge removing device 146 is provided to eject the sheet 100 onto the sheet-exiting tray 104 while removing the electric charge applied to the sheet 100 by the pressing roller 38 that acts as an electric charge applying device.

Here, as shown in FIG. 4, the driven roller 144 is held by a link 147 capable of swinging between two positions as shown by solid and broken lines in a direction as shown by the arrow. Specifically, the link 147 is swingable around the rotation fulcrum 147*a* acting as a fulcrum and rotatably holds the driven roller 144 around a holding fulcrum 147*b*. The link 147 is pivoted by a driving mechanism, not shown.

Respective mechanisms to engage and disengage the above-described driven rollers 137 and 149 with applicable driving rollers are similarly configured as in the above-described mechanism as well.

Further in the double-sided sheet conveying path 304, various conveying rollers, such as a conveying roller 138*a*, a driven roller 138*b*, a conveying roller 139*a*, a driven roller 139*b*, a conveying roller 140*a*, a driven roller 140*b*, etc., are disposed.

Specifically, these conveying rollers 136, 138*a*, 139*a*, and 140*a* each serves as a rotary conveyor at least having a surface composed of conductive-conductive elastic member similar to the conveying roller 136. Here, these conveying rollers 138*a*, 139*a*, and 140*a* are accordingly located on the downstream side of the sheet conveying belt 31. Further, an engaging and disengaging mechanism that engages and disengages each of the driven rollers 138*b*, 139*b*, and 140*b* with these conveying rollers 138*a*, 139*a*, and 140*a*, respectively, includes the same mechanism as the above-described mechanism that engages and disengages with the driven roller 144.

Here, the duplex sheet conveying path 304 is used to refeed the sheet 100 sent thereto toward the pair of registration rollers 134.

The sheet feeding unit 20 is attachably detachable to and from the apparatus body 10 at a front side thereof. The sheet feeding unit 20 includes a sheet feeding cassette 103 to stack and accommodate multiple sheets 100, and a pickup roller to separate and feed the multiple sheets 100 stored in the sheet feeding cassette 103 one by one. The sheet feeding unit 20 also includes a pair of conveying rollers 132.

The sheet feeding unit 20 includes a straight manual sheet feeding tray 105 to be manually used, a pickup roller 141 to pick up and feed the sheet 100 one at a time from the straight manual sheet feeding tray 105, and a pair of conveying rollers 142.

Further, the processing liquid application system 400 includes a deformable bag-shaped processing liquid container, e.g., made of a PET (Poly Ethylene Terephthalate) film, not shown, to contain processing liquid 401 therein and a pump, not shown again, to feed the processing liquid 401 with pressure, when it is supplied from the processing liquid containers. The processing liquid application system 400 also includes a coating unit 410 to coat the sheet 100 acting as a printing medium with the processing liquid 401 or the like. Specifically, the pump pumps up the processing liquid 401 stored in the processing liquid containers, and supplies it to a liquid chamber 402 provided in a coating unit 410 via a supply path, not shown, to prepare for coating of the processing liquid 401.

Here, a liquid level detector, not shown, installed in the liquid chamber 402 detects and confirms that a height of the liquid level and an angle of the liquid plane of the processing liquid 401 supplied to the liquid chamber 402 are within given levels, respectively. Here, the liquid level detector may be an electrode pin system, for example. The electrode pin system is public known and is not described in detail here, but detects the liquid level by supplying electricity to electrode pins through the liquid and checking an electrical conductive level between the electrode pins. In this way, a lack of or excessive supplying of the processing liquid 401 more than a prescribed amount to the liquid chamber 402 can be checked and reduced.

The coating unit 410 includes a conveying roller 434 that conveys the sheet 100, a coating roller 432 opposed to the conveying roller 434 to coat the sheet 100 with the processing liquid 401, and a squeeze roller 433 to supply the processing liquid 401 to the coating roller 432 while thinning it as a liquid film thereof.

Here, the coating roller 432 is placed contacting the conveying roller 434. By contrast, the squeeze roller 433 is placed contacting the coating roller 432. Accordingly, a liquid film layer of the processing liquid 401 is formed on the coating roller 432 when it is supplied by the squeeze roller 433 and the coating roller 432, and is conveyed and applied to the sheet 100 as the coating roller 432 rotates in a prescribed direction.

It is to be noted that the processing liquid 401 serves as quality modification material to modify the quality of the surface of the sheet 100 when applied to the surface of the sheet 100. For example, the processing liquid 401 serves as a fixative (e.g. a setting agent) when uniformly coated onto the sheet 100 in advance. Because, water in the ink is urged to quickly penetrate into the sheet 100 and a color component (of ink) is thickened while hastening the ink to dry to avoid blurring (e.g. feathering bleeding, etc.) and striking through of the ink to a rear surface of the sheet, so that the productivity (i.e., a number of images outputted per unit of time) can be enhanced.

Here, as a chemical composition of the processing liquid 401, solution prepared by adding both cellulose (hydroxypropyl cellulose, etc.,) that promotes penetration of moisture and a base agent such as talc fine powder, etc., to surfactants (e.g., anion, cationic, nonionic, and mixture of two or more of these, etc.,) is exemplified. The chemical composition can further contain fine particles.

Further, the sheets 100 housed in the sheet feeding cassette 103 are separated and fed one at a time by the pickup roller 131 and is sent by the pair of conveying rollers 133 to the pair of registration rollers 134. Subsequently, the sheet 100 is sent from the pair of registration rollers 134 at a predetermined time toward the processing liquid coating unit 400 along a sheet conveying path 300. The processing liquid 401 is then coated onto the sheet 100 by the process fluid coating unit 400.

Now, an attraction principle of the conveying roller attracting a sheet thereto as a rotary conveyor in the image forming apparatus is described with reference to FIG. 5 and applicable drawings. Here, only the conveying roller 143 is typically described. However, the other conveying rollers 136, 148, and 138*a* to 140*a* each has substantially the same configuration and executes substantially the same operation as well.

Since the DC voltage (or an AC voltage superimposed DC voltage) is supplied to the pressing roller 38 as described above, a positive (+) electric charge 700, for example, is applied onto the surface of the sheet 100 (e.g. an image forming surface) sandwiched between the sheet conveying belt 31 and the pressing roller 38.

Since a negative (−) electric charge 701 appears on the sheet conveying belt 31 due to electrostatic induction when the positive charge 700 is applied onto the sheet 100, the sheet 100 may be adsorbed by the sheet conveying belt 31 thereonto by Coulomb force.

At this moment, an attraction force may be further enhanced by previously applying a negative electric charge onto the sheet conveying belt 31 using the electric charging roller 39*a* and 39*b*.

Hence, an image is formed on the sheet 100 by the image forming unit while adsorbing and intermittently conveying the sheet 100 in this way as the sheet conveying bell 31 circulates.

Figure 5:
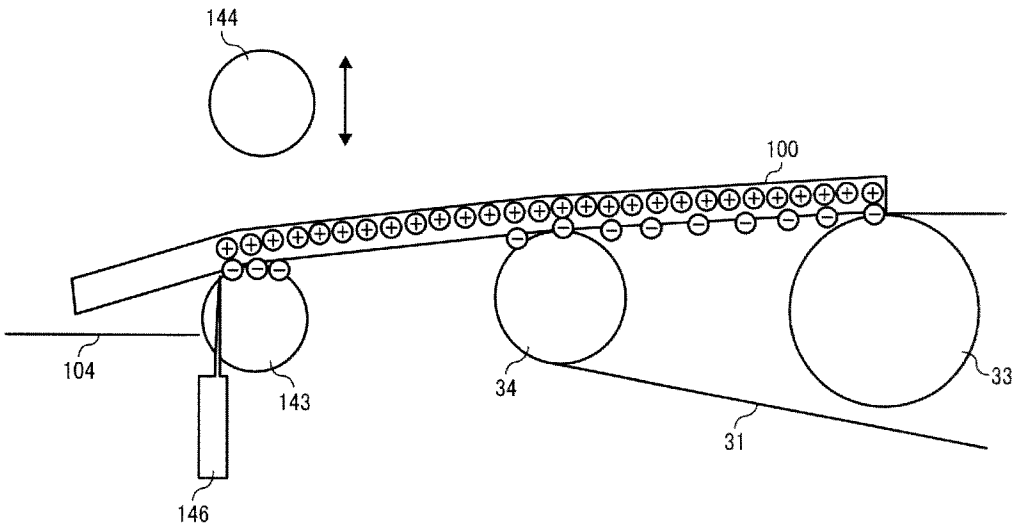
FIG. 5 is a diagram illustrating an attraction principle of a conveying roller that adsorbs a sheet as a rotary conveyor provided in the image forming apparatus of FIG. 1 according to one embodiment of the present invention.

Subsequently, as shown in FIG. 5, the sheet 100 with the image thereon is separated due to curvature of the separating roller 34 from the sheet conveying belt 31.

Further, the sheet 100 separated from the sheet conveying belt 31 is conveyed toward the conveying roller 143 composed of conductive-conductive elastic member. Since a vertex of the conveying roller 143 is lower than an image (sheet) conveying surface formed by the sheet conveying belt 31, the sheet 100 is hardly peeled off from both the conveying roller 143 and the sheet conveying belt 31 even after the sheet 100 is adsorbed onto the conveying roller 143.

At this moment, however, because the positive electric charge 700 has been applied onto the sheet 100, a negative electric charge 701 is electrostatically generated on the surface of the conveying roller 143 composed of an electrically conductive elastic member.

With this, since the positive electric charge 700 in the sheet 100 and the negative electric charge 701 in the conveying roller 143 attract each other, the sheet 100 is adsorbed onto the conveying roller 143 by the Coulomb force.

Here, since a contact area between the conveying roller 143 and the sheet 100 is apparently smaller than that between the sheet conveying belt 31 and the sheet 100, stronger sheet absorption force is needed to constantly convey the sheet 100 than when it is conveyed by the sheet conveying belt 31. In this regards, it is necessary and to raise the electric attraction force of the conveying roller 143 having a different construction from the conveying belt 31 of a two-tier structure composed of an insulating layer on its surface and a resistance controlled (conductive) layer with its resistance controlled by carbon on its backside, the surface of it is composed of a conductive member.

The sheet 100 adsorbed onto the conveying roller 143 is then sent and ejected onto the sheet-exiting tray 104 by the conveying roller 143.

Here, since a charge removing device 146 is disposed between the conveying roller 143 and the sheet-exiting tray 104 to remove the positive electric charge 700 remaining on the sheet 100, the sheet 100 can exit onto the sheet-exiting tray 104 without bearing the positive electric charge 700 thereon. Hence, multiple sheets 100 exiting onto the sheet-exiting tray 104 can probably avoid sticking to each other due generally to the electrostatic charge remaining thereon.

Heretofore, in this embodiment, the conductive elastic member is employed as the exemplary rotary conveyor, because it has a relatively high friction coefficient and accordingly large adsorption force and is prepared at low cost. However, the present invention is not limited thereto, and the similar conveying force can be also obtained by utilizing a belt or a roller at least having a surface composed of a conductive member as well.

Now, an aspect when the sheet 100 bearing the image formed in the image forming unit 2 is linearly ejected onto the sheet-exiting tray 104 is described.

As described earlier, the sheet 100 coated with the processing liquid 401 is conveyed into the sheet conveying path 305 via the pair of conveying rollers 145. Subsequently, in the sheet conveying path 305, the sheet 100 is fed onto the sheet conveying belt 31, in which a DC electric field is formed. The sheet 100 is then given an electric change having a reverse polarity to that of the sheet conveying belt 31 by the pressing roller 38 (also) given an electric charge having a reverse polarity to that of the sheet conveying belt 31. Consequently, the sheet 100 is electrostatically adsorbed onto the sheet conveying belt 31 and is held thereon.

Then, the printing head unit 24 is driven and moved based on an image signal while moving the carriage 23 regarding the sheet 100 and executing printing on the sheet 100 by ejecting droplets thereon to form an image of one line when the sheet 100 reaches and stops at a starting position for starting image formation. When one line printing is completed, the sheet 100 is sent by one line to execute printing on the next line. Thus, by intermittently conveying the sheet 100, an image is successively formed on the sheet 100 (line by line). When receiving either a signal indicating that printing is completed or that indicating that the end of sheet 100 reaches the end of a printing region, the printing is terminated.

Here, the separating roller 34 is moved to a position as shown by the broken line as shown in FIG. 1 (i.e., a position as shown by the solid line in FIG. 4) at latest before the tip of the sheet 100 in the process of image formation reaches the conveying roller 33.

By this, the sheet 100 bearing the image is conveyed and is adsorbed and further conveyed by the conveying roller 143 along the straight sheet ejecting path 306 as the sheet conveying belt 31 moves and circulates. The sheet 100 bearing the image finally exits onto the sheet-exiting tray 104 with the printing surface facing upward. Further, also in this situation, as described earlier, since the electric charge is applied onto the sheet 100, an electric charge having a reverse polarity to that of the sheet 10 is excited (generated) on the conveying roller 143, the sheet 100 is electrostatically adsorbed thereon and is further conveyed by the conveying roller 143.

Now, exemplary operation executed when the sheet 100 bearing the image formed in the image forming unit 2 is inverted and is ejected onto the sheet-exiting tray 104 in the image forming apparatus is described.

Specifically, similar to the situation in which the sheet 100 is linearly ejected, the printing head unit 24 is driven based on an image signal while moving the carriage 23 regarding the sheet 100 and executes printing an image of one line on the sheet 100 when it is conveyed up to a starting position for starting image formation and currently stops there by ejecting droplets thereonto. When the one line is printed, the sheet 100 is sent by an amount of one line to execute printing on the next line. Thus, by intermittently conveying the sheet 100, an image is sequentially formed on the sheet 100 (line by line). When receiving either a signal indicating that the printing is completed or that indicating that the end of sheet 100 reaches the end of a printing region, the printing is terminated.

Here, the separating roller 34 is moved to a position as shown by the solid line in FIG. 1 at latest before the tip of the sheet 100 in the process of image formation reaches the conveying roller 33 again.

By this, the sheet 100 bearing the image formed in this way is subsequently conveyed and diagonally sent downward and is further sent into the sheet-inverting unit 4 through the sheet inverting path 311 by the sheet conveying belt 31 as it circulates.

Since an electric charge has been given to the sheet 100, an electric charge having a reverse polarity to that of the sheet 100 is excited (i.e., generated) in the conveying roller 136 as described earlier, the sheet 100 is electrostatically adsorbed and conveyed by the conveying roller 136 and is taken in by the sheet-inverting unit 4.

Further, the sheet 100 conveyed into the sheet-inverting unit 4 subsequently evacuates from the sheet-inverting unit 4 as the conveying roller 136 reversely rotates. At this moment, a path switching nail 41 is located at a position as shown by a solid line in the drawing, and accordingly, the sheet 100 fed out by the pair of conveying rollers (136 and) 137 is conveyed toward the sheet inverting and ejecting path 309.

In the sheet inverting and ejecting path 309, since the electric charge has been given to the sheet 100, an electric charge having a reverse polarity to that of the sheet 100 is excited in the conveying roller 148 as described earlier, the beck side of the sheet 100 opposite a front side bearing the image formed in this way is electrostatically adsorbed by the conveying roller 148 and is thereby conveyed downstream.

The sheet 100 is subsequently sent to the conveying roller 143 from the sheet inverting and ejecting path 309. Subsequently, since the electric charge is given to the sheet 100, an electric charge having a reverse polarity to that of the sheet 100 is excited in the conveying roller 143 as described earlier, the sheet 100 is electrostatically adsorbed and conveyed by the conveying roller 143. The sheet 100 consequently exits onto the sheet-exiting tray 104 with its printing surface facing down.

Here, since the conveying roller 143 is also used in executing the straight sheet ejection, the conveying roller 143 adsorbs the image printed surface of the sheet 100 when the sheet inverting and ejecting process is executed. However, when compared with the straight sheet ejecting process, since the sheet 100 passes through the sheet-inverting unit 4 in the sheet inverting and ejecting process, an ink drying and settling time can be relatively sufficiently ensured before the sheet 100 reaches the conveying roller 143, and accordingly, the ink almost never adheres to the conveying roller 143.

Here, by supposing that the sheet 100 having property of poor ink drying fixative is conveyed, the driven roller 144 disposed opposed to the conveying roller 143 can also be composed of conductive elastic member as well so that the sheet 100 can be adsorbed onto the driven roller 144 and is conveyed in the sheet inverting and ejecting process.

As is apparent from the sheet inverting and ejecting path, all of the conveying rollers placed downstream of the sheet conveying belt 31 while facing the back side of the sheet 100 are not necessarily conductive to adsorb the sheet 100, and only some of the conveying rollers need be conductive to adsorb the sheet 10 as well. In particular, a prescribed conveying roller disposed closer to the sheet conveying belt 31 is preferably enabled to adsorb the sheet 100.

Now, operation of forming multiple images on both sides of the sheet 100 respectively is described.

As described above, the sheet 100 coated with the processing liquid 401 is conveyed to sheet conveying path 305 via the pair of rollers 145. In the sheet conveying path 305, the sheet 100 is fed onto the sheet conveying belt 31, in which a DC electric field is formed. The sheet 100 is subsequently given an electric change having a reverse polarity to that of the sheet conveying belt 31 by the pressing roller 38 also given an electric field (or charge) having a reverse polarity to that of the sheet conveying belt 31. Accordingly, the sheet 100 can be electrostatically adsorbed onto the sheet conveying belt 31 and is held thereon.

Then, the printing head unit 24 is driven based on an image signal while moving the carriage 23 regarding the sheet 100 and executes printing an image of one line by ejecting droplets onto the sheet 100 conveyed up to and currently stopping at a starting position for starting image formation. Hence, by intermittently conveying the sheet 100, an image is sequentially formed on the sheet 100 (line by line). When the one line is printed, the sheet 100 is sent by one line to execute printing on the next line. When receiving either a signal indicating that the printing is completed or that indicating that the end of sheet 100 reaches the end of a printing region, the printing is terminated.

Here, the separating roller 34 is moved to a position as shown by the solid line in FIG. 1 at latest before the tip of the sheet 100 in the process of image formation reaches the conveying roller 33.

By this, the sheet 100 bearing the image formed in this way is subsequently conveyed and diagonally sent downwardly and is further sent into the sheet-inverting unit 4 through the sheet inverting path 311 by the sheet conveying belt 31 as it circulates.

Since the electric charge has been given to the sheet 100, an electric charge having a reverse polarity to that of the sheet 100 is excited in the conveying roller 136 as described earlier, the sheet 100 is electrostatically adsorbed and is conveyed by the conveying roller 136. The sheet 100 is subsequently taken in by the sheet-investing unit 4.

Further, the sheet 100 conveyed into the sheet-inverting unit 4 subsequently evacuates from the sheet-inverting unit 4 as the conveying roller 136 reversely rotates. At this moment, a path switching nail 41 is located at a position as shown by a broken line in the drawing, and accordingly, the sheet 100 sent by the pair of conveying roller (136 and) 137 is conveyed toward the double-sided sheet conveying path 304. The sheet 100 is subsequently conveyed by multiple conveying rollers 138*a* & 139*a*, and 140*a* and is sent to the pair of registration roller 134 again.

Here, as described earlier, since the electric charge has been applied onto the sheet 100 again, a reverse polarity to that in the sheet 10 is excited (i.e., generated) on the multiple conveying rollers 138*a* to 140*a*, the sheet 100 is electrostatically adsorbed thereonto and is further conveyed by these multiple conveying rollers 138*a* to 140*a*.

Subsequently, the sheet 100 sent to the pair of registration rollers 134 is resent therefrom at a predetermined time toward the processing liquid coating unit 400 via the sheet conveying path 300.

The processing liquid 401 is subsequently coated onto the sheet 100 by the process fluid coating unit 400 as described above. Subsequently, after an image is formed on the other side of it in the image forming unit 2, the sheet 100 is further conveyed as the sheet conveying belt 31 shown by a broken line circulates and exits onto the sheet-exiting tray 104 along the straight sheet ejecting path 306 with its printing side facing upward as the conveying roller 143 rotates.

Now, operation of a straight sheet ejection process in which the sheet 100 is almost linearly fed and conveyed from the manual sheet feeding tray 105 is described.

Specifically, by using the manual sheet feeding tray 105, an image can be easily formed on a special sheet, such as a cardboard, a sticker release paper sheet, etc., as well. Further, since a path extended from the manual sheet feeding tray 105 joins the sheet conveying path downstream of the processing liquid coating unit 400 in the conveying direction, a sheet such as a coated sheet, etc., not requiring coating of the processing liquid is preferably fed from the manual sheet feeding tray 105 as well. For this reason, the manual sheet feeding tray 105 is enabled to load several sheets thereon while enabling the pickup roller 141 to pick up and supply the sheets 100 one at a time.

Specifically, the sheets 100 housed in the manual sheet feeding tray 105 are separated and fed one at a time by the pickup roller 141, and is conveyed by the conveying roller 142 toward the printing sheet conveying path 305. Subsequently, as described above, the sheet 100 is intermittently conveyed by the sheet conveying belt 31 again, and an image is formed thereon in the image forming unit 2.

Subsequently, the sheet 100 bearing the image is further conveyed as the sheet conveying belt 31 shown by a broken line circulates and exits onto the sheet-exiting tray 104 through the straight sheet ejecting path 306 with its printing side facing upward as the conveying roller 143 rotates.

Heretofore, conveying operation of the multiple driven rollers 137, 149, 144, and 138*b* to 140*b* is not described. However, as described earlier, in accordance with a sheet type and environmental conditions (such as temperature, humidity, etc.,) or the like, the driven rollers 137, 149, 144, and 138*b* to 140*b* are moved to contact the respective conveying rollers 136, 148, 144, and 138*a* to 140*a* to press the sheet 100 thereagainst.

Figure 6:
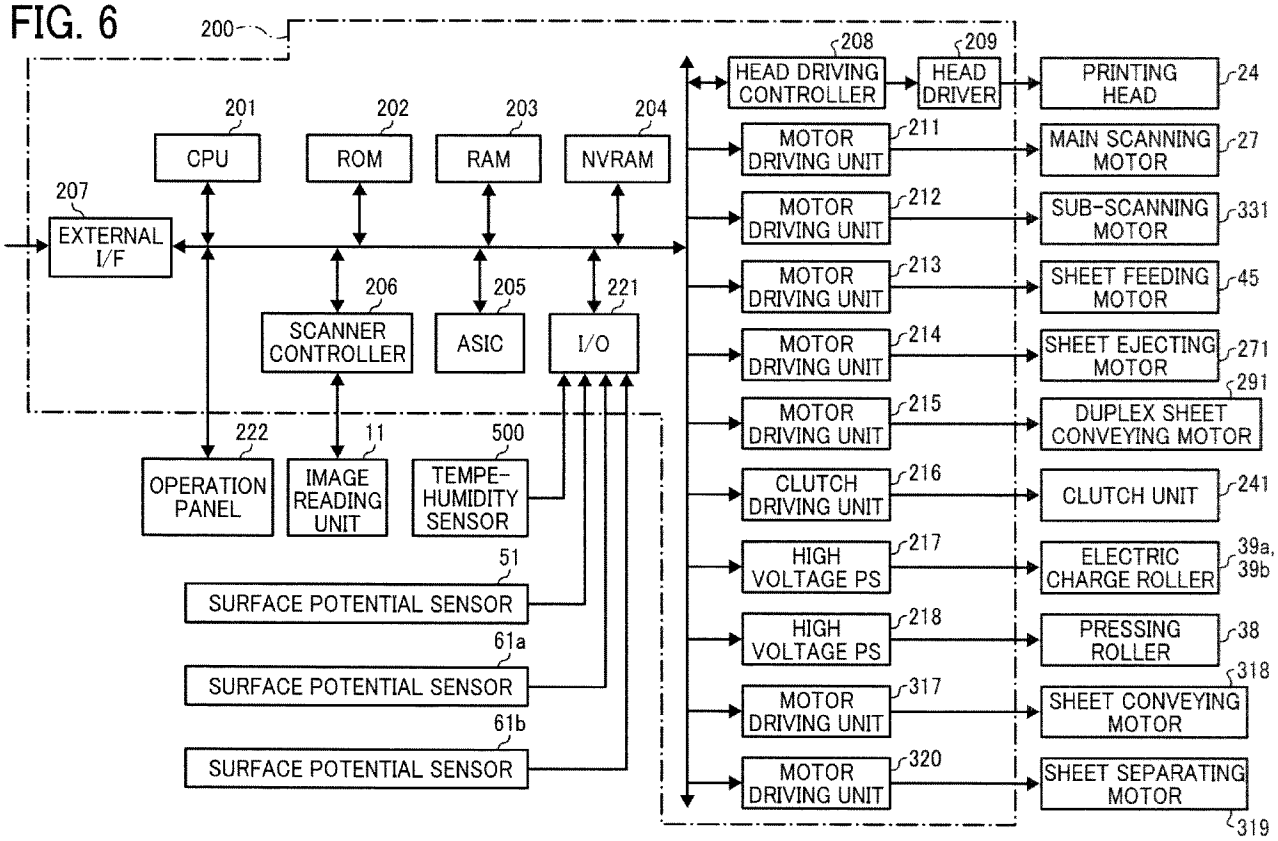
FIG. 6 is a block diagram of a control unit provided in the image forming apparatus of FIG. 1 according to one embodiment of the present invention.

Now, an overview of a control unit provided in the image forming apparatus is described with reference to FIG. 6.

Specifically, the control unit 200 is comprised of a CPU (central processing unit) 201 that generally controls the image forming apparatus, a ROM (read only memory) 202 that stores programs and the other fixed data implemented by the CPU 201, and a RAM (random access memory) 203 that temporarily stores image data (i.e., printing data), etc.

The control unit 200 also includes a non-volatile memory (NVRAM) 204 that holds data even when a power supply is interrupted. The control unit 200 also includes an ASIC (application specific integrated circuit) 205 that applies various signal processes to image data, executes image forming processes such as sorting, etc., and handles input and output signals other than those of processes to generally control the image forming apparatus.

Further, the control unit 200 also includes a scanner control section 206 that controls an image reading unit 11 to read an image and processes image data read by the image reading unit 11 and so forth.

The control unit 200 also includes an I/F (Interface) 207 used to receive data from an external device and is enabled to send and receive data and signals. The control unit 200 also includes a printing head-driving control section 208 and a printing head driver 209 collectively controlling the printing head unit 24 included in the image forming unit 2 to operate.

Further included in the control unit 200 are a motor driving unit 211 that drives a main scanning motor 27 to execute main scanning of the carriage 23, and a motor-driving unit 212 that drives the sub-scanning motor 331 to rotate the conveying roller 32 and accordingly circulate the sheet conveying belt 31.

Further included in the control unit 200 are a motor driving unit 213 that drives a sheet feeding motor 45, and a motor driving unit 214 that drives a sheet ejection motor 271 to operate and rotate various rollers, such as the pair of sheet ejecting roller 143, the pair of conveying rollers 144, etc.

Further included in the control unit 200 are a motor driving unit 215 that drives a double-sided sheet conveying motor 291 to drive and rotate various rollers located in a duplex sheet conveying path 304, and a motor-driving unit 317 that drives a conveying motor 318 to drive and rotate the pair of conveying rollers 137 located in the sheet-inverting unit 4.

The control unit 200 also includes a motor driving unit 320 that drives a separating motor 319 to move the separating roller 34.

The control unit 200 further includes a clutch driving unit 216 that drives a clutch unit 241. The clutch unit 241 includes multiple sheet feeding-electromagnetic clutches which independently drive and rotate the pickup roller 131 and the pair of conveying rollers 132, and the pickup roller 141 and the pair of conveying rollers 142, respectively. Further, the clutch group 241 includes an electromagnetic clutch that independently drives the sheet conveying paths and a path switching plate solenoid that pivots the path switching nail 41 to switch the sheet conveying path to the other.

The control unit 200 further includes the high voltage power supply 217 that supplies a high voltage to the pair of electric charging rollers 39*a* and 39*b*. The high voltage power supply 217 can independently control each of the high voltages applied to the pair of charging rollers 39*a* and 39*b*, respectively.

The control unit 200 further includes a high voltage power supply 218 that supplies a high voltage to the pressing roller 38.

The control unit 200 also includes an I/O (Input and Output port) 221 that captures detection signals from various sensors. Specifically, to the I/O 221, a detection signal is inputted from the temperature humidity sensor 500 that detects temperature and humidity as an environmental condition. Also inputted to the I/O 221 are detection signals from an image formation starting sensor, not shown, and an image formation end sensor, not shown. Further inputted to the I/O 221 are measuring signals from the respective surface potential sensors 51, 61*a*, and 61*b*.

Further, an operation panel 222 is connected to the control unit 200 to input and display information necessary for the apparatus.

Accordingly, the control unit 200 processes and stores read image data in a buffer included in the scanner control unit 206 when the image reading unit 11 reads an image of an original document. By contrast, the control unit 200 stores printing data or the like in a buffer included in an external I/F 207 upon receiving it from an external host, such as an information processing device (e.g., a personal computer), an image reader (e.g., an image scanner), an imaging device (e.g. a digital camera), etc., via the external I/F 207.

Then, the CPU 201 reads image data from the scanner control unit 206 or the I/F 207, and analyzes the image data. The ASIC 205 then executes necessary image processing and data reordering processing or the like and transfers printing image data to a printing head-driving control unit 208. Here, dot pattern data for outputting an image based on data sent from the external device can be generated by storing font data in the ROM 202, for example. Otherwise, image data can be spread as bitmap data by a printer driver provided in the external host, and is transferred to the image forming apparatus.

Upon receiving the image data (e.g., the dot pattern data) corresponding to one line of each printing head of the printing head unit 24, the printing head-driving control unit 208 transfers the one line dot pattern data to a printing head driver 209. Based on the dot pattern data, the printing head driver 209 selectively provides a driving waveform and drives an actuator included in the printing head unit 24 and let a prescribed nozzle of the printing head of the of the printing head unit 24 discharge a droplet therefrom.

Hence, in the image forming apparatus configured in this way, the sheet 100 is fed one by one from either the sheet feeding unit 20 or the double-sided sheet conveying path 310 and is pressed against the sheet conveying belt 31 by the pressing roller 38. As a result, a conveying direction of the sheet 100 is changed by an angle of about 90°. The sheet 100 is then electrostatically adsorbed onto the sheet conveying belt 31 and is further conveyed in the sub-scanning direction as the sheet conveying belt 31 circulates.

Then, the printing head unit 24 is driven based on an image signal and executes printing an image of one line on the currently stopping sheet 100 by ejecting a droplet thereonto while moving the carriage 23. When one line printing is completed, the sheet 100 is sent by one line to execute printing on the next line. In this way, by intermittently conveying the sheet 100, an image is sequentially formed on the sheet 100 (e.g., line by line).

Upon receiving either a signal indicating that the printing is completed or that indicating that the end of sheet 100 reaches the end of a printing region, the printing is terminated.

At this moment, by moving the separating roller 34 between positions in accordance with usage of the sheet conveying path as shown by solid and broken lines in the drawing as described above, the sheet conveying path for conveying the sheet 100 bearing the image is switched. The sheet 100 is accordingly sent onto the sheet-exiting tray 104 via a prescribed conveying path.

Now, charging control applied to the sheet 100 via control of power supplying to the pressing roller 38 according to one embodiment of the present invention is described with reference to FIGS. 7 and 9 and applicable drawings.

Figure 7:
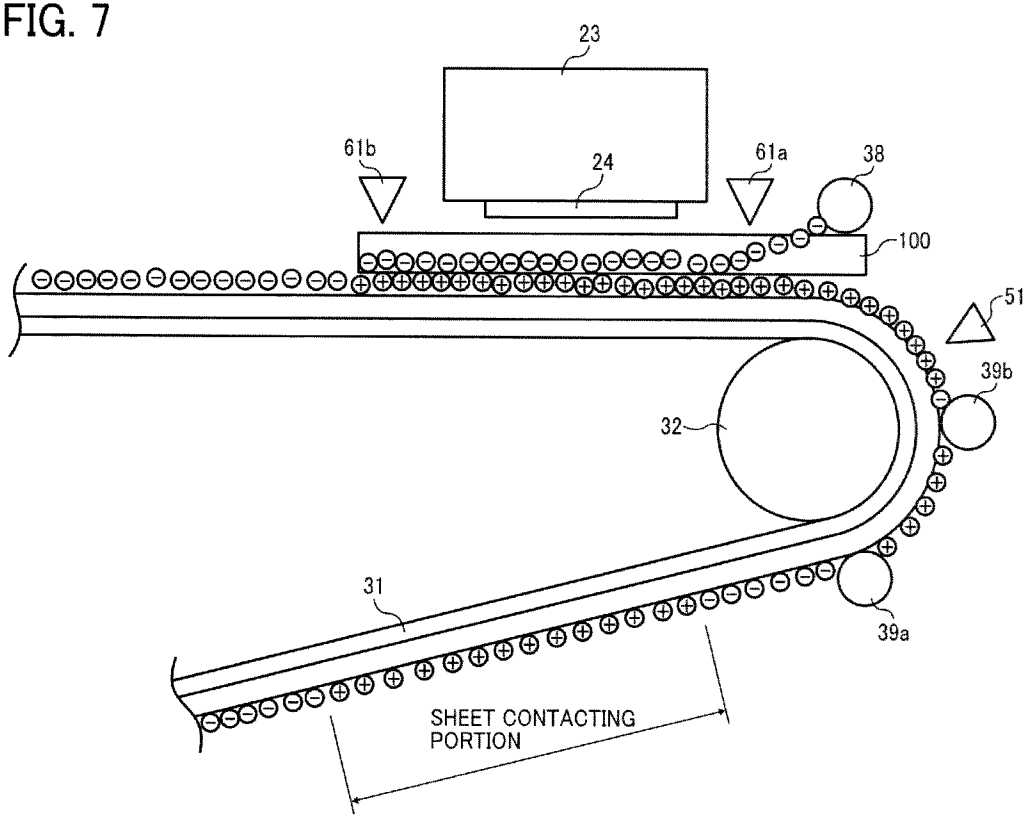
FIG. 7 is a diagram illustrating an exemplary charged state of the sheet and that of a conveying belt when electric charging control executed (by controlling power supply to a pressing roller) is according to one embodiment of the present invention.
Figure 8:
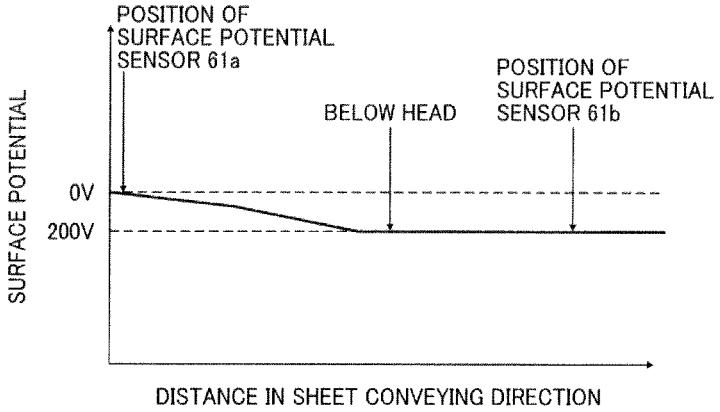
FIG. 8 is a chart illustrating exemplary result of measuring a surface potential of the sheet according to one embodiment of the present invention.

FIG. 7 is a diagram illustrating a charged state of each of the sheet 100 and the conveying belt 31 when charging control is implemented thereon via control of power supplying to the pressing roller 38. FIG. 8 is a chart illustrating an exemplary result of measuring a surface potential of the sheet 100. FIG. 9 is a chart illustrating a target value of the sheet surface potential.

Initially, as shown in FIG. 7, the high voltage power supply 217 provides a high voltage to the electric charging roller 39*a*. The electric charging roller 39*a* provides positive electric charge the sheet conveying belt 31. Thus, the sheet conveying belt 31 bears the positive electric charge thereon. Similarly, the high voltage power supply 217 supplies a high voltage to the electric charging roller 39*b*. The electric charging roller 39*b* then supplies (positive) electric charge the sheet conveying belt 31 to electrically positively charge the sheet conveying belt 31 uniformly so that it bears the positive electric charge thereon.

Such a positively charged state of the sheet conveying belt 31 is detected by the surface potential sensor 51. The control unit 200 subsequently adjusts the high voltage (i.e., the power supply voltage) supplied from the high voltage power supply 217 to the electric charging roller 39*b* based on the detection result to render the surface potential to be a given value.

By contrast, the sheet 100 is conveyed onto the sheet conveying belt 31 bearing the positive electric charge thereon. At this moment, by receiving negative electric charge, the sheet 100 is negatively electrically charged by the pressing roller 38 to which a high voltage is supplied from the high voltage power supply 218.

By negatively charging the sheet 100 from above the sheet 100, since the electric charge on the sheet 100 and that on the sheet conveying belt 31 are balanced, the surface potential on the sheet 100 can be reduced.

At this moment, due to electrical resistance of the sheet 100, the negative electric charge borne thereon takes a prescribed time to reach a back side thereof. In particular, at low temperature and low humidity environment, since the electrical resistance of the sheet 100 is relatively high as $10^{12}$ Ω-cm, the surface potential near the surface potential sensor 61*a* and that below the printing head unit 24 is different from each other as shown in FIG. 8.

Accordingly, in this embodiment, the surface potential sensor 61*b* is also disposed downstream of the printing head unit 24 to act as a second surface potential detector to detect surface potential of the sheet 100 to be able to accurately estimate the surface potential under the printing head unit 24.

Specifically, a target value of the surface potential to be adjusted and targeted is determined and set based on a result of the detection obtained by the surface potential sensor 61*b*. Then, a supply voltage supplied to the pressing roller 38 is controlled and adjusted to render an electric charge provided by the pressing roller 38 to be the target value base on the result of detection of the surface potential sensor 61*a*.

Figure 9:
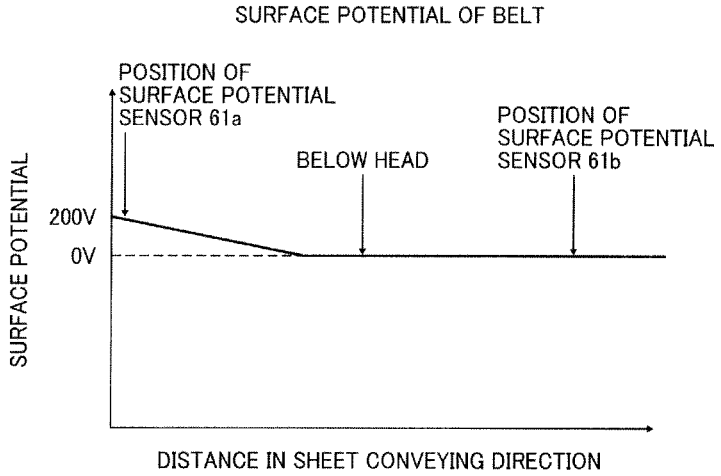
FIG. 9 is a chart illustrating a target value of a sheet surface potential according to one embodiment of the present invention.

Specifically, when a surface potential of the sheet 100 is detected to be a value as shown in FIG. 8, a target value targeted to generate a detection signal by the surface potential sensor 61*a* is determined and set to 200 V as shown in FIG. 9.

With this, the surface potential under the printing head unit 24 becomes almost zero volts as shown in FIG. 9.

Here, the above-described example discusses a situation in which the surface potential under the printing head unit 24 becomes almost zero volts when 200V is set as the target. However, the target value may be preferably chosen and set in accordance with a position of the surface potential sensor 61*b* as well.

Here, it is noted that when a power supply voltage supplied to the pressing roller 38 is controlled only by the surface potential sensor 61*b*, since it (i.e., the surface potential sensor 61*b*) is far distanced from the pressure roller 38, a delay time occurs from when the surface potential is detected to when its detection result is fed back to a power supply voltage to be supplied to the pressure roller 38. As a result, adjustment of the power supply voltage is delayed and as a problem.

By contrast, by placing multiple surface potential sensors at least two positions as in the above-described embodiment, the surface potential of the sheet under the printing head can be more quickly exactly reduced.

With this, reflux of the mist back to the printing head from the sheet can be reduced while enabling formation of a high-quality image.

In this way, the electric field (or charge) can be reduced under the image forming device by employing a first electric charger that provides electric charge the sheet conveyor, a second charger that provides electric charge the printing medium conveyed by the sheet conveyor, a first surface potential detector that measure a surface potential of the printing medium bearing the electric charge, a second surface potential detector that measures a surface potential of the printing medium bearing the electric charge, and a controller that adjusts a power supply voltage supplied to each of the first and second electric chargers in accordance with each of surface potentials detected by the first and second surface potential detectors, while locating the first and second surface potential detector at different positions in a conveying direction in which the printing medium is conveyed by the sheet conveyor.

In such a situation, since the first surface potential detector is placed upstream of the image forming device in the conveying direction and the second surface potential detector is placed downstream of the image forming device in the conveying direction, the target value capable of reducing the electric (or charge) on the sheet under the image forming device can be more accurately be determined and set.

Figure 10:
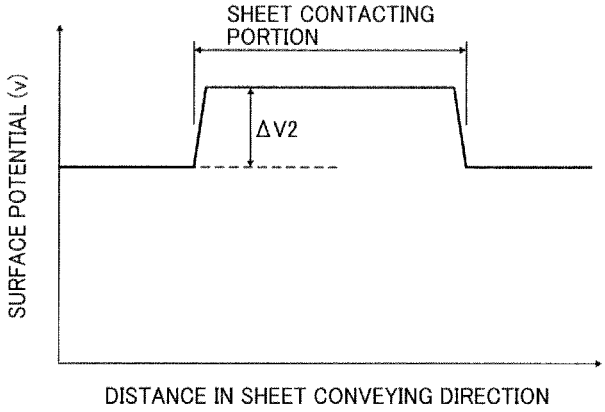
FIG. 10 is a chart illustrating a change in surface potential of a conveying belt employed in a comparative example that employs only a single electric charging roller.
Figure 11:
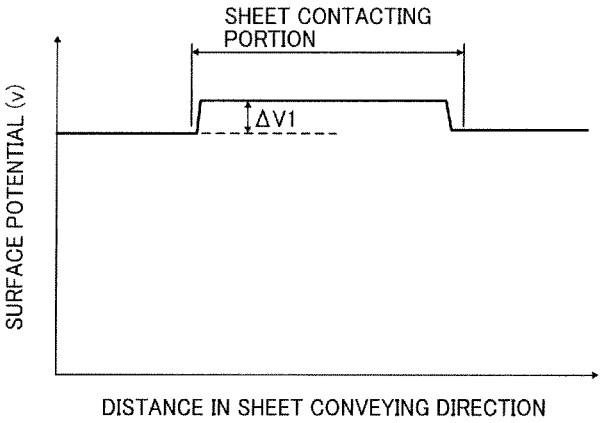
FIG. 11 is a chart illustrating a change in surface potential of conveying belt according to one embodiment of the present invention.

Now, the electric charging device for providing electric charge the conveying belt is described more in detail with reference to FIGS. 10 and 11. FIG. 10 is a chart illustrating a change in surface potential of a conveying belt employed in a comparative example when only one electric charging roller is used. FIG. 11 is a chart illustrating a change in surface potential of a conveying belt according to one embodiment of the present invention.

As described above, according to this embodiment, the multiple (e.g., two) charging rollers 39*a* and 39*b* are deployed at different positions in the conveying direction and collectively discharge the sheet conveying belt 31. Then, such a positively charged state is detected by the surface potential sensor 51. The control unit 200 then adjusts the high voltage (i.e., the power supply voltage) supplied from the high voltage power supply 217 to the electric charging roller 39*b* to render the surface potential to be a given value based on result of the detection.

By contrast, when the sheet conveying belt 31 is charged only by a single charging roller 39, (i.e., as a comparative example), a surface potential generated on the sheet conveying belt 31 varies in accordance with the sheet conveying distance as shown in FIG. 10.

In other words, a portion of the sheet conveying belt 31 contacting the sheet 100 is positively and (negatively) charged thereby generating a surface potential. By contrast, a portion of the sheet conveying belt 31 not contacting the sheet 100 is negatively charged by the electric charging roller 39, because the electric charging roller 38 provides the negative charge.

As a result, the surface potential is not uniform as shown in FIG. 10.

By contrast, when the sheet conveying belt 31 is charged by using two electric charging rollers 39*a* and 39*b* as in this embodiment, the surface potential of the sheet conveying belt 31 changes a shown in FIG. 11.

That is, since charging operation is executed twice in this embodiment, a difference in surface potential between the contact portion contacting the sheet 100 and the non-contact portion not contacting the sheet 100 becomes smaller when compared with the comparative example of FIG. 10. Specifically, when it is supposed that a difference in potential of this embodiment is represented by $\Delta V1$ (delta V1) while that of the comparative example of FIG. 10 is represented by $\Delta V2$ (delta V2), the following inequality is established; $\Delta V1<\Delta V2$.

Figure 12:
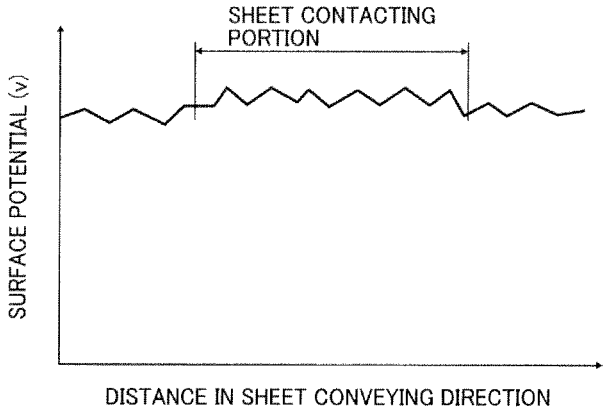
FIG. 12 is a chart illustrating an exemplary unfavorable change in surface potential of the conveying belt of the comparative example that employs only the single electric charging roller having a relatively low electrical resistance to show a difference from that of one embodiment of the present invention that employs multiple electric charging rollers.
Figure 13:
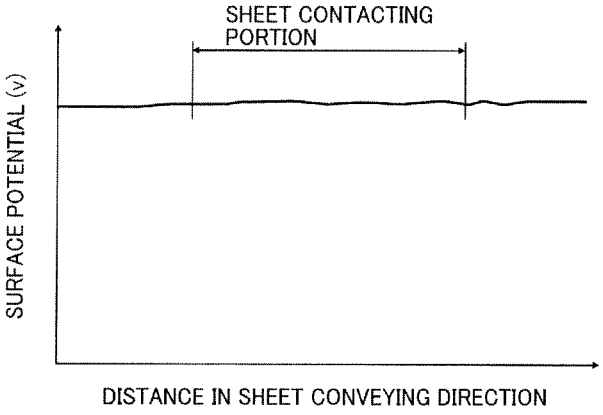
FIG. 13 is a chart illustrating another exemplary change in surface potential of the conveying belt according to one embodiment of the present invention.

Now, an exemplary electrical resistance of each of the electric charging rollers 39*a* and 39*b* is described with reference to FIGS. 12 and 13. FIG. 12 is a chart illustrating an exemplary change in surface potential in a sheet-conveying belt provided in the comparative example in accordance with the sheet conveying distance. FIG. 13 is a chart illustrating an exemplary change in surface potential occurred in a sheet-conveying belt in accordance with the sheet conveying distance according to one embodiment of the present invention.

Initially, an example of a surface potential in the sheet conveying belt 31 generated when an electrical resistance of an electric charging roller is changed from $10^{4.5}\Omega$ (23° C. 50%) to $10^{3.5}\Omega$ (23° C. 50%) described with reference to FIG. 12.

When the electrical resistance is relatively small, an electrically charged state becomes almost uniform. However, electric discharging varies and the surface potential finely fluctuates in such a situation.

By contrast, when the electrical resistance of the electric charging roller 39*a* is $10^{3.5}\Omega$ (23° C. 50%) and that of the electric charging roller 39*b* is $10^{4.5}\Omega$ (23° C. 50%), the surface potential on the sheet conveying belt 31 changes in accordance with the sheet conveying distance as shown in FIG. 13.

Hence, it is recognized from these experiencing results that the fine fluctuation of the surface potential, generally occurring when the electrical resistance of the single electric charging roller is small, can be reduced, when multiple electric charging rollers 39*a* and 39*b* are employed on a condition that the electrical resistance of the electric charging roller 39*a* on the upstream side is less than that of the electric charging roller 39*b* on the downstream side.

Figure 14A:
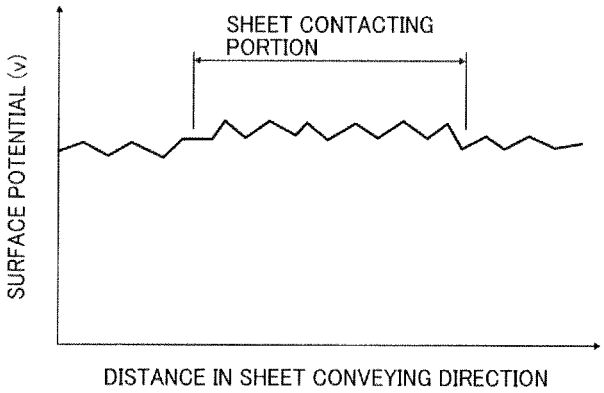
FIGS. 14A and 14B are diagrams collectively illustrating a change in surface potential of the conveying belt to show a relation between power supply voltages supplied to multiple electric charging rollers according to one embodiment of the present invention.
Figure 14B:
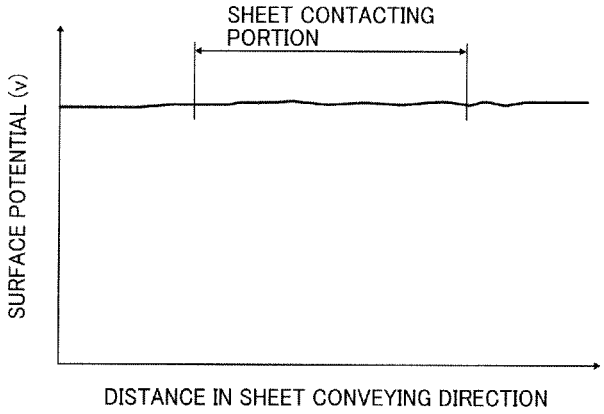

Now, a relation between power supply voltages supplied to the multiple electric charging rollers, respectively, are described with reference to FIGS. 14A and 14B. FIGS. 14A and 14B are charts collectively illustrating a change in surface potential of the conveying belt.

It is preferable that a power supply voltage supplied to the electric charging roller 39*a* on the upstream side is less than that of the electric charging roller 39*b* on the downstream side.

That is, since it is possible to enhance a surface potential from low to high levels, a variation of electric charge created by the electric charging roller 39*a* can be reduced by discharging with the electric charging roller 39*b* as shown in FIG. 14A. Because, a supply voltage higher than that supplied to the electric charging roller 39*a* is supplied to the electric charging roller 39*b*.

However, since it is impossible to reduce a surface potential from high to low levels, the variations of electric charge caused by the electric charging roller 39*a* cannot be reduced when the charging roller 39*b* on the downstream side is lower.

Further, for the similar reason, when the sheet conveying belt 31 is rendered to be a prescribed electrically charged state by adjusting a power supply voltage supplied to the electric charging roller 39*b* based on result of detection 2 of the surface potential sensor 51, a power supply voltage supplied to the electric charging roller 39*a* is set to be lower than that supplied to the electric charging roller 39*b*.

Here, in the present invention, material of the sheet is not limited to just paper and rather includes an OHP (overhead projector) sheet, cloth, glass, and a baseboard or the like. Further, the sheet includes material capable of attracting an ink drop and the other liquid or the like, such as a direct printing medium, an indirect printing medium, a printing sheet, a printing form, etc. Further, it is noted here that image formation, recording, printing, imaging, and duplicating are synonyms to each other.

It is also noted here that, the image forming apparatus represents a system that executes image formation by ejecting droplets onto a medium made of such as paper, yarn, fiber, fabric, leather, metal, plastic, glass, wood, ceramics, etc. It is also noted here that, the image formation onto the medium represents not only simply providing a meaningful image, such as a character, a figure, etc., but also a meaningless image5 such as simply landing droplets on the medium, etc.

It is also noted here that, the ink is not particularly limited to so called ink unless particularly so described, and includes a DNA sample, resist, pattern material, and resin or the like. Specifically, the ink is a general term that represents liquid capable of forming an image, such as so called printing liquid, fixing operation processing liquid, ordinary liquid, etc.

Further, the image is not limited to be flat and includes an image formed on a three dimensional object by applying it thereto, and that three dimensionally formed while three-dimensionally modeling the object as well.

Further, the image forming apparatus includes both of a serial type image forming apparatus and a line type image forming apparatus unless otherwise specifically limited to one of them.

According to one aspect of the present invention, an electric field generated under an image forming device (e.g. a printing head) can be effectively reduced with a simple configuration. That is, an image forming apparatus includes an image forming device to eject a droplet and form an image on a printing medium; a sheet conveyor to convey the printing medium with the image; at least one first electric charger to charge the sheet conveying unit; a second charger to charge the printing medium conveyed by the sheet conveying unit; a first surface potential detector to detect a surface potential of the printing medium bearing the electric charge; a second surface potential detector to detect a surface potential of the printing medium bearing the electric charge; and a controller to adjust a power supply voltage supplied to each of the first and second electric chargers in accordance with each of surface potentials detected by the first and second surface potential detectors. The first and second surface potential detectors are located at different positions in a conveying direction in which the printing medium is conveyed by the sheet conveying unit.

According to another aspect of the present invention, an electric field generated under an image forming device (e.g. a printing head) can be more effectively reduced with a simple configuration. That is, the first surface potential detector is placed upstream of the image forming device and the second surface potential detector is placed downstream of the image forming device in the conveying direction.

According to yet another aspect of the present invention, an electric field generated under an image forming device (e.g. a printing head) can be more effectively reduced with a simple configuration. That is a target value of the surface potential is determined based on result of detection of the second surface potential detector, and the power supply voltage is adjusted to render the surface potential to be the target value based on result of detection of the first surface potential detector.

According to yet another aspect of the present invention, an electric field generated under an image forming device (e.g. a printing head) can be more effectively reduced with a simple configuration. That is the multiple first electric chargers are aligned in the conveying direction.

According to another aspect of the present invention, an electric field generated under an image forming device (e.g. a printing head) can be more effectively reduced with a simple configuration. That is each of the multiple first electric chargers is made of conductive material having a given electrical resistance, and the electrical resistance of the first electric charger disposed upstream is smaller than that disposed downstream in the conveying direction.

According to another aspect of the present invention, an electric field generated under an image forming device (e.g. a printing head) can be more effectively reduced with a simple configuration. That is the power supply voltage supplied to the first electric charger disposed upstream is lower than that disposed downstream in the conveying direction.

According to another aspect of the present invention, an electric field generated under an image forming device (e.g. a printing head) can be more effectively reduced with a simple configuration. That is the controller adjusts only the power supply voltage to be supplied to one of the at least two first electric chargers disposed most downstream in the conveying direction.

Numerous additional modifications and variations of the present invention are possible in light of the above teachings. It is therefore to be understood that within the scope of the appended claims, the present invention may be executed otherwise than as specifically described herein. For example, the order of steps for forming in the image forming apparatus is not limited to the above-described various embodiments and may be altered as appropriate.

What is claimed is:

1. An image forming apparatus, comprising:

a printing device to eject a droplet and form an image on a printing medium;

a printing medium conveying unit to convey the printing medium with the image in a prescribed conveying direction;

at least one first electric charger to charge the printing medium conveying unit;

a second electric charger to charge the printing medium conveyed by the printing medium conveying unit;

a first surface potential detector to detect a surface potential of the printing medium bearing the electric charge;

a second surface potential detector to detect a surface potential of the printing medium bearing the electric charge; and a controller to adjust a power supply voltage supplied to each of the at least one first electric charger and the second electric charger in accordance with each of surface potentials detected by the first surface potential detector and the second surface potential detector, wherein the first surface potential detector and the second surface potential detector are located at different positions in the conveying direction in which the printing medium is conveyed by the printing medium conveying unit.

2. The image forming apparatus, as claimed in claim 1, wherein the first surface potential detector is placed upstream of the printing device in the conveying direction and the second surface potential detector is placed downstream of the printing device in the conveying direction.

3. The image forming apparatus, as claimed in claim 1, wherein the controller:

determines a target value based on the surface potential detected by the second surface potential detector, and adjusts the power supply voltage supplied to each of the at least one first electric charger and the second electric charger to render the surface potential of the printing medium to be the target value based on the surface potential detected by the first surface potential detector.

4. The image forming apparatus as claimed in claim 1, wherein the multiple first electric chargers are placed in the conveying direction.

5. The image forming apparatus, as claimed in claim 4, wherein each of the multiple first electric chargers is made of semi-conductive material having a given electrical resistance, wherein the electrical resistance of one of the multiple first electric chargers disposed upstream is smaller than the electrical resistance of another one of the multiple first electric chargers disposed downstream in the conveying direction.

6. The image forming apparatus, as claimed in claim 4, wherein the power supply voltage supplied to one of the multiple first electric chargers disposed upstream of the printing device is lower than the power supply voltage supplied to another one of the multiple first electric chargers disposed downstream thereof in the conveying direction.

7. The image forming apparatus, as claimed in claim 4, wherein the controller adjusts only the power supply voltage to be supplied to the extreme downstream first electric charger in the conveying direction.

8. A method of forming an image forming, comprising the steps of:

locating a first surface potential detector and a second surface potential detector at different positions in a conveying direction in which a printing medium is conveyed by a printing medium conveying unit;

ejecting a droplet and forming an image on a printing medium;

conveying the printing medium with the image in a prescribed conveying direction;

charging the printing medium conveying unit;

charging the printing medium conveyed by the printing medium conveying unit;

detecting a surface potential of the printing medium bearing the electric charge;

detecting a surface potential of the printing medium bearing the electric charge; and adjusting a power supply voltage supplied to each of the at least one first electric charger and the second electric charger in accordance with each of surface potentials detected by the first surface potential detector and the second surface potential detector.

9. The method as claimed in claim 8, wherein the first surface potential detector is placed upstream of the printing device in the conveying direction and the second surface potential detector is placed downstream of the printing device in the conveying direction.

10. The method as claimed in claim 8, further comprising the steps of:

determining a target value based on the surface potential detected by the second surface potential detector, and adjusting the power supply voltage supplied to each of the at least one first electric charger and the second electric charger to render the surface potential of the printing medium to be the target value based on the surface potential detected by the first surface potential detector.

11. The method as claimed in claim 8, wherein the multiple first electric chargers are placed in the conveying direction.

12. The method as claimed in claim 11, wherein each of the multiple first electric chargers is made of semi-conductive material having a given electrical resistance, wherein the electrical resistance of one of the multiple first electric chargers disposed upstream is smaller than the electrical resistance of another one of the multiple first electric chargers disposed downstream in the conveying direction.

13. The method as claimed in claim 11, wherein the power supply voltage supplied to one of the multiple first electric chargers disposed upstream of the printing device is lower than the power supply voltage supplied to another one of the multiple first electric chargers disposed downstream thereof in the conveying direction.

14. The method as claimed in claim 11, wherein the controller adjusts only the power supply voltage to be supplied to the extreme downstream first electric charger in the conveying direction.

* * * * *